US008766868B2

(12) United States Patent
Szini et al.

(10) Patent No.: US 8,766,868 B2
(45) Date of Patent: Jul. 1, 2014

(54) RESONANT STRUCTURE TO MITIGATE NEAR FIELD RADIATION GENERATED BY WIRELESS COMMUNICATION DEVICES

(75) Inventors: Istvan J. Szini, Grayslake, IL (US); Hugh K. Smith, Palatine, IL (US)

(73) Assignee: Motorola Mobility LLC, Chicago, IL (US)

( * ) Notice: Subject to any disclaimer, the term of this patent is extended or adjusted under 35 U.S.C. 154(b) by 954 days.

(21) Appl. No.: 12/649,985

(22) Filed: Dec. 30, 2009

(65) Prior Publication Data

US 2010/0164826 A1 Jul. 1, 2010

Related U.S. Application Data

(60) Provisional application No. 61/142,139, filed on Dec. 31, 2008.

(51) Int. Cl.
*H01Q 1/52* (2006.01)

(52) U.S. Cl.
USPC ..... 343/841

(58) Field of Classification Search
USPC ..... 343/841
See application file for complete search history.

(56) References Cited

U.S. PATENT DOCUMENTS

| | | | | |
|---|---|---|---|---|
| 4,121,218 | A | 10/1978 | Irwin et al. | |
| 4,313,119 | A | 1/1982 | Garay et al. | |
| 4,630,061 | A | 12/1986 | Hately | |
| 4,725,845 | A | 2/1988 | Phillips | |
| 5,014,346 | A | 5/1991 | Phillips et al. | |
| 5,337,061 | A | 8/1994 | Pye et al. | |
| 5,561,436 | A | 10/1996 | Phillips | |
| 5,572,223 | A | 11/1996 | Phillips et al. | |
| 6,246,374 | B1 | 6/2001 | Perrotta et al. | |
| 6,727,785 | B2 | 4/2004 | Killen et al. | |
| 6,822,611 | B1 | 11/2004 | Kontogeorgakis et al. | |
| 7,330,156 | B2 | 2/2008 | Arkko et al. | |
| 7,633,449 | B2 * | 12/2009 | Oh et al. | 343/702 |
| 2006/0044195 | A1 * | 3/2006 | Arkko et al. | 343/702 |

OTHER PUBLICATIONS

U.S. Appl. No. 12/415,835 to Pulimi et al., filed Mar. 31, 2009.

* cited by examiner

*Primary Examiner* — Robert Karacsony

(57) ABSTRACT

A method (600) and an RF circuit (100, 400, 500) for a wireless communication device that mitigates near electric fields generated by the wireless communication device. At least one resonant structure (108, 408, 408') can be configured to resonate at or near at least one operating frequency of an antenna (102) of the wireless communication device. The antenna can be a component of the RF circuit. The resonant structure can be electromagnetically coupled to the antenna to mitigate the near electric fields at the operating frequency in order to comply with an applicable hearing aid compatibility (HAC) specification.

14 Claims, 3 Drawing Sheets

RESONANT STRUCTURE TO MITIGATE NEAR FIELD RADIATION GENERATED BY WIRELESS COMMUNICATION DEVICES

CROSS REFERENCE TO RELATED APPLICATIONS

This application claims benefit of U.S. provisional patent application Ser. No. 61/142,139, filed Dec. 31, 2008, which is herein incorporated by reference.

BACKGROUND OF THE INVENTION

1. Field of the Invention

The present invention generally relates to RF antennas and, more particularly, to RF antennas for mobile communication devices.

2. Background of the Invention

The Hearing Aid Compatibility Act of 1988 (HAC Act) requires that the Federal Communications Commission (FCC) ensure that telephones manufactured or imported for use in the United States after August 1989 are compatible with hearing aids. When the Act was passed in 1988, Congress specifically exempted from the hearing aid compatibility requirements "telephones that are used with public mobile services" (e.g. wireless telephones). To ensure that the HAC Act keep pace with the evolution of telecommunications, however, Congress granted the FCC the authority to revoke or limit the exemptions provided in the HAC Act for wireless telephones.

The use of wireless telephones by consumers in the United States proliferated significantly in the years following the HAC act, and by 2003 the FCC determined that continuation of the exemption for wireless telephones would adversely affect individuals with hearing disabilities. Moreover, the FCC also determined that providing a limitation on this exemption was both technologically feasible and in the public interest. Pursuant to these determinations, and acting under its authority granted by congress, the FCC implemented new rules for hearing aid compatibility applicable to digital wireless telephones. These rules became effective in 2005.

The new rules implemented by the FCC establish extended existing telecoil coupling requirements and established new limits on both electric and magnetic near fields generated by digital wireless telephones in the RF spectrum. Further, the rules mandate that a percentage of the digital wireless telephones provided by wireless manufactures and carriers must meet the near field RF radiation limits, and that these limitations must be met without compromising the overall performance of the digital wireless telephones for users with hearing aids.

An indicator of a wireless telephones performance is the telephone's total radiated power (TRP). TRP represents the amount of power radiated by a wireless telephone, and therefore roughly correlates to its broadcast range. Thus, to comply with the applicable FCC rules for hearing aid compatibility, digital wireless telephones should provide sufficient TRP while maintaining both electric near field radiation and magnetic near field radiation within the applicable limits specified by the FCC.

SUMMARY OF THE INVENTION

The present invention relates to a method of mitigating near electric fields generated by a wireless communication device. The method can include configuring at least one resonant structure to resonate at or near one more operating frequencies of an antenna of the wireless communication device. The method also can include electromagnetically coupling to at least one resonant structure to the antenna in order to mitigate the near electric fields at the operating frequency in order to comply with an applicable hearing aid compatibility (HAC) specification.

Another aspect of the present invention relates to a RF circuit for a wireless communication device. The RF circuit can include an antenna and at least one resonant structure configured to resonate at or near at least one or more operating frequencies of an antenna of the wireless communication device. The resonant structure can be electromagnetically coupled to the antenna to mitigate near electric fields of the antenna at the operating frequency of the antenna in order to comply with an applicable hearing aid compatibility (HAC) specification.

BRIEF DESCRIPTION OF THE DRAWINGS

Preferred embodiments of the present invention will be described below in more detail, with reference to the accompanying drawings, in which.

DETAILED DESCRIPTION

While the specification concludes with claims defining features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting but rather to provide an understandable description of the invention.

Arrangements described herein relate to mitigating near electric fields generated by wireless communication devices without appreciably degrading their transmission and reception performance. Specifically, the present arrangements describe architectures that limit the generation of the near electric fields generated by communication device antennas and other components without significantly interfering with the far field transmission and reception characteristics of a wireless communication device. Moreover, these architectures are well suited for adaptation in mass production of wireless communication devices while requiring very few dedicated components. Accordingly, the arrangements described herein provide manufacturers of wireless communication devices a cost effective means for complying with applicable rules promulgated by the Federal Communications Commission (FCC) under the Hearing Aid Compatibility Act of 1988 (HAC Act).

Figure 1:
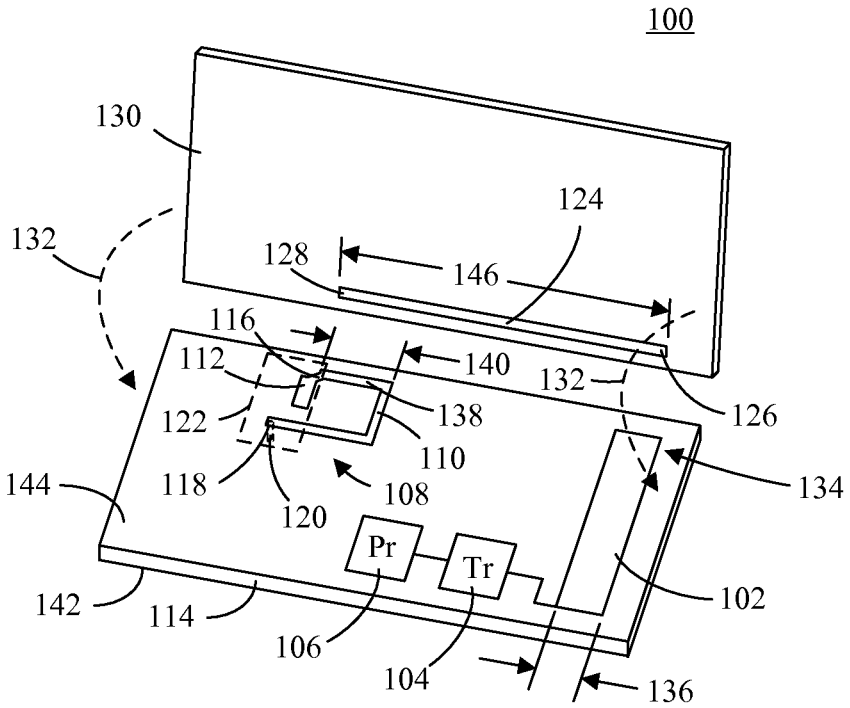
FIG. 1 depicts a RF circuit of a wireless communication device that is useful for understanding the present invention.

FIG. 1 depicts a RF circuit 100 of a wireless communication device that is useful for understanding the present invention. The RF circuit 100 can include an antenna 102, a transmitter 104, a processor/controller 106, and/or any other suitable components. The antenna 102 can be a planar antenna, a folded-J antenna, a monopole antenna, a dipole antenna, a patch antenna, a ceramic chip antenna, or any other suitable type of antenna. The transmitter 104 can be dedicated to exclusively transmitting electromagnetic signals, or a can be a transceiver which both transmits and receives electromagnetic signals.

The processor/controller 106 can be coupled to the transmitter 104 which, in turn, may be coupled to the antenna 102. The coupling between the processor/controller 106 and the antenna 104, as well as the coupling between the transmitter 104 and the antenna 102, may be implemented via electrical coupling and/or electromagnetic coupling. The processor/controller 106 can communicate to the transmitter 104 signals that are to be transmitted via the antenna 102. The transmitter 104 can be configured to up-convert these signals to the RF spectrum from the frequency spectrum in which they are received from the processor/controller 106 (e.g. the audio frequency spectrum), and then communicate the up-converted signals to the antenna 102 for transmission. As known to those skilled in the art, such signals may be converted to a baseband spectrum prior to being up-converted to the RF spectrum, but the invention is not limited in this regard.

The RF circuit 100 also can include a resonant structure 108. The resonant structure 108 can include a first portion 110 having an inductive impedance and a second portion 112 having a capacitive impedance. In this regard, the first portion 110 and the second portion 112 can form a parallel resonant structure, also commonly known as a tank circuit.

The first and second portions 110, 112 can comprise, for example, conductive traces disposed on a printed circuit board 114. In one arrangement, the resonant structure 108 can be configured to resonate at a frequency that is below an operating frequency of the antenna 102. For example, if the antenna 102 operates at 850 MHz, the resonant structure can be tuned to resonate at 830 MHz. In another arrangement, the resonant structure 108 can be configured to resonant at the operating frequency of the antenna 102. In yet another arrangement, the resonant structure 108 can be configured to resonate at a frequency that is above the operating frequency of the antenna 102.

The first portion 110 can be, for example, generally U-shaped or have any other shape suitable for providing the inductive impedance. Moreover, the dimensions and length of the first portion 110 can be selected to achieve a desired inductance, as would be appreciated by those skilled in the art. The first portion 110 can include a first port 116 electrically coupled to the second portion 112, and a second port 118 electrically coupled to ground potential, for instance using a via 120, a pin, or any other suitable conductor that is electrically coupled to a ground plane 122.

The second portion 112 can capacitively couple to a ground plane 122 to generate a desired capacitive impedance between the second portion 112 and the ground plane 122. The area of the second portion 112 (e.g. length and width) can be selected to provide a desired capacitive impedance based on the permittivity and the thickness of the printed circuit board 114, as would be appreciated by the skilled artisan.

The ground plane 122 can be positioned on a side 142 of the printed circuit board 114 opposite a side 144 on which the resonant structure 108 may be positioned, positioned within the printed circuit board 114 (e.g., using a multi-layer printed circuit board), or positioned in any other suitable manner which allows for a desired amount of capacitive coupling between the second portion 112 and the ground plane 122. Further, the first portion 110 and/or the second portion 112 of the resonant structure 108 also can be positioned within the printed circuit board 114 or on the side 144.

The inductance provided by the first portion 110 and the capacitance provided by the second portion 112 can be selected to achieve a desired resonant frequency for the resonant structure 108. The selection of the resonant frequency will be described herein.

A guide medium 124 can be positioned between the antenna 102 and the resonant structure 108 so as to electromagnetically couple the antenna 102 to the resonant structure 108. The guide medium 124 can comprise a conductor, a waveguide, and/or any other guide mediums that guide electricity, electric fields, magnetic fields and/or electromagnetic fields. The guide medium 124 can be configured to have a structure that is straight, curved, or comprise any of a myriad of different structural geometries. For example, the guide medium 124 can include portions which are straight, portions which are curved, portions which include angles, and so on.

The guide medium 124 can include a first port 126 that is electromagnetically coupled (e.g. capacitively coupled) to the antenna 102 and a second port 128 that is electromagnetically coupled (e.g. capacitively coupled) to the resonant structure 108. The guide medium 124 can provide the electromagnetic coupling when a structure 130 to which the guide medium 124 is attached (e.g. a second printed circuit board) is positioned proximate to the printed circuit board 114. For instance, the structure 130 can be folded over the printed circuit board 114 as represented by the dashed assembly lines 132 depicted in the figure.

In an alternative arrangement, the guide medium 124 can be positioned on the circuit board 114, proximate to (e.g., above or below) the resonant structure 108 and proximate to (e.g., above or below) the antenna 102. One or more dielectric mediums (not shown) can be positioned between the guide medium 124 and the resonant structure 108, as well as between the guide medium 124 and the antenna 102. In an arrangement in which the circuit board 114 is a multilayer circuit board, the guide medium 124 can be positioned on a circuit board layer that is different than the circuit board layer(s) on which the resonant structure 108 and the antenna 102 are positioned. The dielectric medium also may be defined by a space between the resonant structure 108 and the antenna 102 and/or one or more dielectric materials inserted between the resonant structure 108 and the antenna 102. The dielectric medium can be selected to achieve a desired amount of electromagnetic coupling of the resonant structure 108 to the antenna 102. For example, the distance between the resonant structure 108 and the antenna 102, the thickness of the dielectric material, and the permittivity of the dielectric material may be selected to achieve a desired amount of electromagnetic coupling.

The guide medium 124 may be configured so that the first portion 126 of the guide medium 124 electromagnetically couples to a portion 134 of the antenna 102. The portion 134 can be, for example, an end portion of the antenna 102. The guide medium 124 can be positioned so as to optimize the area of the portion 134 of the antenna 102 to which the first portion 126 of the guide medium 124 electromagnetically couples, while not significantly interfering with the performance of the antenna 102. For example, the first portion 126 of the guide medium can extend across, or nearly across, an entire width 136 of the antenna 102.

Similarly, the guide medium 124 may be configured so that the second portion 128 of the guide medium 124 electromagnetically couples to the resonant structure 108. For example, the portion 128 of the guide medium 124 can be positioned parallel to a portion 138 of the resonant structure 110 so as to maximize electromagnetic coupling to the portion 138. For example, the second portion 128 of the guide medium 124 can be positioned to extend an entire length 140, or nearly the entire length 140, of the portion 138 of the resonant structure 108.

Table 1 presents experimental data of measured electric field strength at various frequencies generated by an RF circuit of a communication device under test, both with and without implementing the resonant structure 108 of FIG. 1 in the RF circuit. When the resonant structure 108 was present, its resonant frequency $f_r$ was selected to be approximately 15 MHz below the antenna's transmit frequency of 824 MHz.

Table 1 includes a first column indicating the various test frequencies at which the electric field strength was measured, a second column indicating the HAC electric field limit, a third column indicating the measured electric field strength at each of the test frequencies when the resonant structure was not present in the RF circuit, a fourth column indicating the normalized measured electric field strength at each of the test frequencies when the resonant structure was present in the RF circuit, and a fifth column that indicates the electric field strength reduction achieved by use of the resonant structure 108 in the RF circuit.

TABLE 1

| Frequency (MHz) | HAC E-Field Limit (dBV/m) | Meas. E-Field - No Resonant Structure (dBV/m) | Meas. E-Field, Normalized - With Resonant Structure (dBV/m) | Resonant Structure E-Field Reduction, Normalized (dBV/m) |
|---|---|---|---|---|
| 824 | 48.50 | 49.91 | 48.14 | 1.77 |
| 836 | 48.50 | 49.82 | 48.30 | 1.52 |
| 849 | 48.50 | 49.26 | 48.39 | 0.87 |

When the RF circuit was tested without using the resonant structure 108, at each of the test frequencies the measured electric field strength exceeded the maximum limit of 48.50 dBV/m as specified by an applicable HAC specification. When the resonant structure 108 was implemented in the RF circuit, at each of the test frequencies the electric field strength generated by the RF circuit was again measured. In this test setup, the total radiated power (TRP) generated by the RF circuit also was measured, and marginally decreased, however, in comparison to the TRP generated by the RF circuit when the resonant structure 108 was not present. Accordingly, the electric field strengths that were measured with the resonant structure 108 present in the RF circuit were normalized based on the measured TRP so as to compensate for the TRP reduction. In other words, an appropriate value was determined for normalizing the electric field strength measurements, and that value was added to each of the electric field strength measurements to determine what the electric field strengths would be if the TRP were to be increased to the same level that was generated when the resonant structure was absent from the RF circuit. The measured electric field strengths, both before and after normalization, measured to be lower than the maximum limit. Indeed, after normalization, the electric field strengths were reduced by 1.77 dBV/m, 1.52 dBV/m, and 0.87 dBV/m at 824 MHz, 836 MHz and 849 MHz, respectively, in comparison to the field strengths that were measured when the resonant structure 108 was absent.

At this point it should be noted that these particular test frequencies, and the results obtained, are presented herein for example purposes. Nonetheless, the resonant structure 108 can be implemented to operate at any other suitable RF frequencies. As noted, the dimensions of the first and second portions 110, 112 of the resonant structure 108 can be selected to desired resonant frequency for the resonant structure. For instance, the dimensions of the first portion 110 and/or second portion 112 can be decreased to increase the resonant frequency, or these dimensions can be increased to lower the resonant frequency. In addition to, or in lieu of, selecting different dimensions for the first portion 110 and/or second portion 112, the permittivity and/or permeability of a dielectric material within the circuit board 114 can be selected to achieve a desired resonant frequency.

Figure 2:
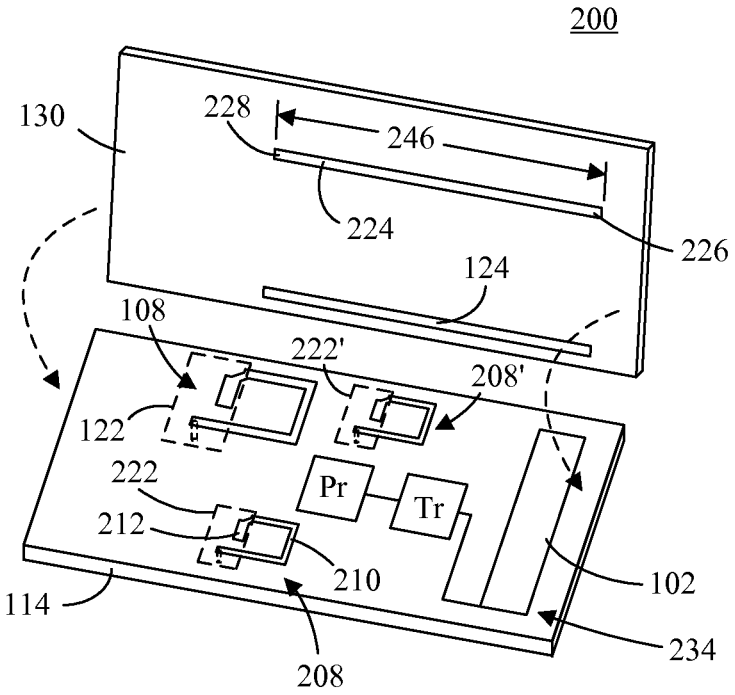
FIG. 2 depicts another RF circuit of a wireless communication device that is useful for understanding the present invention.

FIG. 2 depicts another RF circuit 200 of a wireless communication device that is useful for understanding the present invention. In the RF circuit 200, one or more additional resonant structures can be configured as parallel resonant structures in order to mitigate the near electric fields generated by the RF circuit 200 at the operating frequency of the antenna 102 in order to comply with an HAC specification. For example, the first resonant structure 108 can be configured to resonate at a first operating frequency, and a second resonant structure 208 can be configured as a parallel resonant structure to resonant at a second operating frequency.

The resonant structure 208 can comprise at least a first portion 210 having an inductive impedance, and at least a second portion 212 having a capacitive impedance. A ground plane 222 can be used to create a desired capacitance for the second portion 212, for instance as previously described for the resonant structure 108. Alternatively, the ground plane 122 can be configured to extend below the resonant structure 208 to provide the desired capacitance.

In this arrangement, a second guide medium 224 can be configured to electromagnetically couple to a second portion 234 of the antenna 102. For example a first port 226 of the guide medium 224 can be electromagnetically coupled to the antenna 102, and a second port 228 of the guide medium 224 can be electromagnetically coupled to the second resonant structure 208. Such electromagnetic coupling can be implemented as previously described for the guide medium 124. Also as previously described for the guide medium 124, the guide medium 224 can be poisoned on the structure 130 or as otherwise suitable. For example, the guide medium 224 can be located on a particular layer of the circuit board 114 or otherwise positioned to suitably electromagnetically couple to the antenna 102 and the resonant structure 208. Moreover, a length 246 of the guide medium 224 can be selected to achieve desired operational characteristics, for instance as previously described for the guide medium 124.

In another arrangement, the resonant structure 208' can be positioned so as to electromagnetically couple to the guide medium 124, and the ground plane 222' can be positioned accordingly. In this arrangement, the guide medium 224 may not be required. Still, any number of additional resonant structures, ground planes and guide mediums may be provided, and the invention is not limited in this regard.

Figure 3:
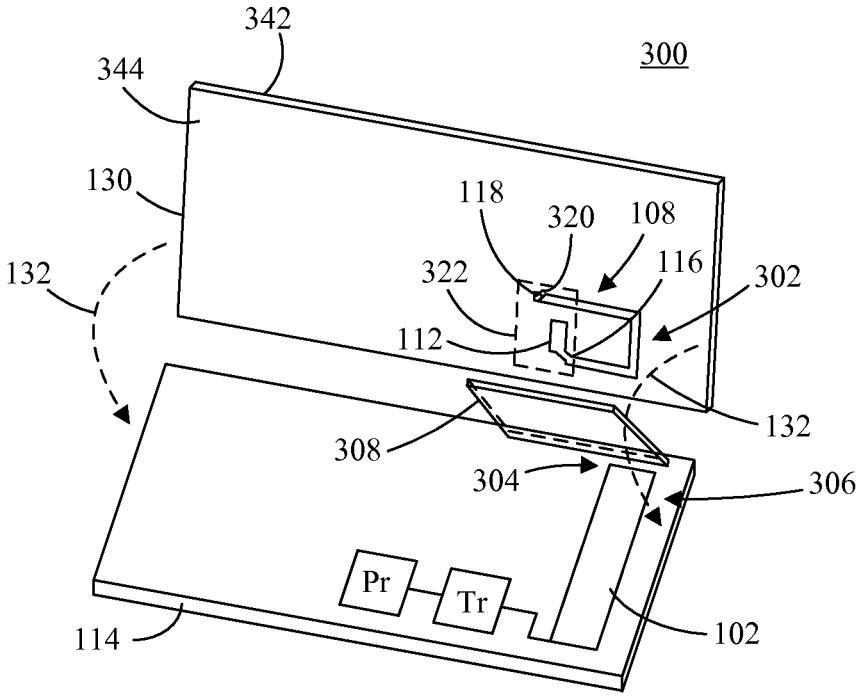
FIG. 3 depicts yet another RF circuit of a wireless communication device that is useful for understanding the present invention.

FIG. 3 depicts yet another RF circuit 300 of a wireless communication device that is useful for understanding the present invention. In this arrangement, a guide medium need not be required to couple the resonant structure 108 to the antenna 102. Instead, the resonant structure 108 can be positioned such that a portion 302 of the resonant structure 108 can be coupled to the antenna 102 via a dielectric region 304 defined between the portion 302 and the antenna 102, for example between the portion 302 and a portion 306 of the antenna 102.

In illustration, the dielectric region 304 can be defined to be formed when the structure 130 is folded over the printed circuit board 114 as represented by the dashed assembly lines 132 depicted in the figure. In this regard, the structure 130 also can be a printed circuit board, but this need not be the case.

In one arrangement, a space can be maintained between the resonant structure 108 and the antenna 102 to provide electrical insulation between the resonant structure 108 and the antenna 102, while facilitating electromagnetic coupling based on the permittivity within the space (e.g., the permittivity of air). In another arrangement, one or more dielectric materials 308 may be positioned to provide electrical insulation between the resonant structure 108 and the antenna 102 and/or to facilitate electromagnetic coupling of the resonant structure 108 to the antenna 102. For example, a permittivity and thickness of the dielectric material (or dielectric materials) 308 can be selected to achieve a desired amount of electromagnetic coupling.

In yet another arrangement, both a space can be maintained between the resonant structure 108 and the antenna 102 in addition to the use of one or more dielectric materials 308 being positioned between the resonant structure 108 and the antenna 102. In this arrangement, in addition to the thickness and permittivity of the dielectric materials 308, the amount of space and the permittivity therein can be chosen to achieve a desired amount of electromagnetic coupling.

As with the previous examples, the first portion 302 of the resonant structure 108 can include a first port 116 electrically coupled to the second portion 112, and a second port 118 electrically coupled to ground potential, for instance using a via 320, a pin, or any other suitable conductor that is electrically coupled to a ground plane 322. In this example, however, the ground plane 322 can be positioned on a side 342 of the structure 130 opposite a side 344 on which the resonant structure 108 may be positioned, positioned within the structure 130, or positioned in any other suitable manner which allows for a desired amount of capacitive coupling between the second portion 112 and the ground plane 322. Further, the first portion 302 and/or the second portion 112 of the resonant structure 118 also can be positioned within the structure 130 or on the side 344. As noted, the area of the second portion 112 (e.g. length and width) can be selected to provide a desired capacitive impedance based on the permittivity and the thickness and permittivity of the structure 130, as would be appreciated by the skilled artisan.

Figure 4:
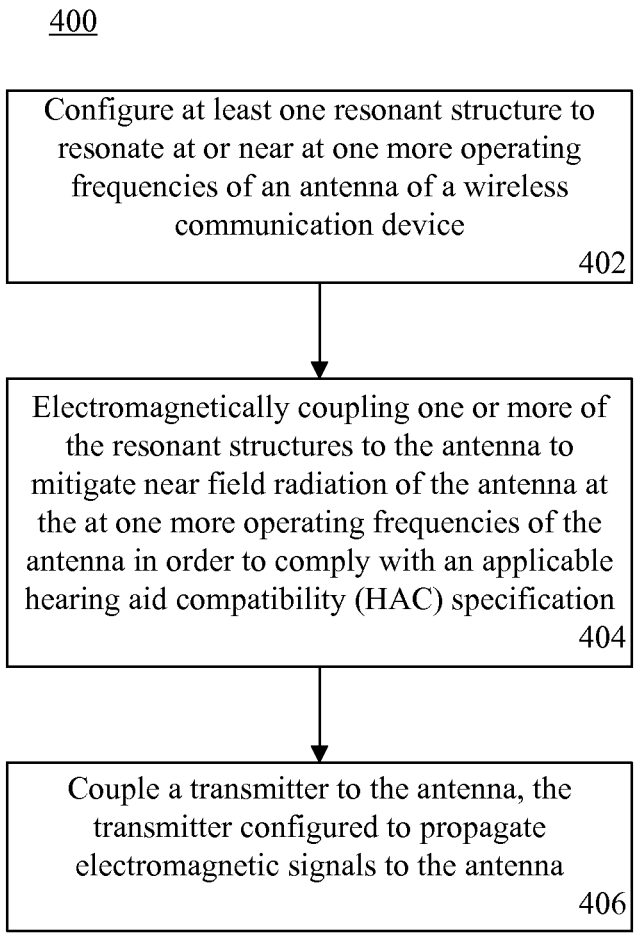
FIG. 4 is a flowchart presenting a method of mitigating near electric fields generated by a wireless communication device, which is useful for understanding the present invention.

FIG. 4 is a flowchart presenting a method 400 of mitigating near field radiation generated by a wireless communication device, which is useful for understanding the present invention. At step 402, one or more resonant structures can be configured to resonate at or near one or more operating frequencies of an antenna of the wireless communication device. For example, in one arrangement, a first resonant structure can be configured to resonate at or near a first operating frequency of the antenna. In another arrangement, a first resonant structure can be configured to resonate at or near a first operating frequency of the antenna, and a second resonant structure can be configured to resonate at or near a second operating frequency of the antenna. Still, other resonant structures can be provided to resonate at or near other operating frequencies of the antenna, and the invention is not limited in this regard.

At step 404, the resonant structure(s) can be electromagnetically coupled to the antenna to mitigate near field radiation of the antenna at the operating frequency or frequencies of the antenna in order to comply with an applicable HAC specification. At step 406, a transmitter can be coupled to the antenna. The transmitter can be configured to propagate electromagnetic signals to the antenna at a desired operating frequency.

The terms "a" and "an," as used herein, are defined as one or more than one. The term "plurality," as used herein, is defined as two or more than two. The term "another," as used herein, is defined as at least a second or more. The terms "including" and/or "having," as used herein, are defined as comprising (i.e. open language). The term "electrically coupled," as used herein, is defined as connected, although not necessarily directly, and not necessarily mechanically, e.g., communicatively linked through a communication channel or pathway or another component or system.

The term "electromagnetically coupled," as used herein, is defined as being coupled via one or more electric fields, magnetic fields and/or electromagnetic fields via at least one medium that is generally not considered to be a conductor, for example via one or more dielectric mediums, although one or more guide mediums may be used to provide a guided path between electromagnetic coupling regions when a plurality of electromagnetic coupling regions are used. In this regard, components that are "electromagnetically coupled" may be coupled via a single electromagnetic coupling region, or via two or more electromagnetic coupling regions and one or more guide mediums that provide at least one guided path between electromagnetic coupling regions.

As used herein, a "guide medium" is a medium that guides the propagation of electricity, an electric field, a magnetic field and/or an electromagnetic field. Examples of a guide medium include, but are not limited to, a conductor and a wave guide. A waveguide can comprise at least two mediums. For example, a waveguide can comprise a first dielectric region that is bounded at least on one side by a conductor, a ferromagnetic region, and/or a second dielectric region having a permittivity that is different than a permittivity of the first dielectric region.

Moreover, as used herein, ordinal terms (e.g. first, second, third, fourth, fifth, sixth, seventh, eighth, ninth, tenth, and so on) distinguish one message, signal, item, object, device, system, apparatus, step, process, or the like from another message, signal, item, object, device, system, apparatus, step, process, or the like. Thus, an ordinal term used herein need not indicate a specific position in an ordinal series. For example, a process identified as a "second process" may occur before a process identified as a "first process." Further, one or more processes may occur between a first process and a second process.

This invention can be embodied in other forms without departing from the spirit or essential attributes thereof. Accordingly, reference should be made to the following claims, rather than to the foregoing specification, as indicating the scope of the invention.

What is claimed is:

1. A method of mitigating near electric fields generated by a wireless communication device, comprising:

configuring at least a first resonant structure to resonate at or near at least a first operating frequency of an antenna of the wireless communication device, wherein the first resonant structure does not include a feed port;

electromagnetically coupling the first resonant structure to the antenna to mitigate the near electric fields at the operating frequency; and coupling a transmitter to the antenna, the transmitter being configured to communicate electromagnetic signals to the antenna; and wherein configuring the first resonant structure to resonate at or near the first operating frequency of the antenna of the wireless communication device comprises:

configuring the first resonant structure to comprise at least a first portion having an inductive impedance and at least a second portion having a capacitive impedance; and wherein configuring the first resonant structure to resonate at or near the first operating frequency of the antenna of the wireless communication device comprises:

positioning the second portion of the first resonant structure proximate to a ground plane to establish the capacitive impedance between the second portion and the ground plane; and wherein configuring the first resonant structure to resonate at or near the operating frequency of the antenna of the wireless communication device further comprises:

electrically coupling a first port of the first portion of the first resonant structure to the second portion of the first resonant structure; and electrically coupling a second port of the first portion of the first resonant structure to a ground potential; and wherein the first portion and the second portion are coplanar.

2. The method of claim 1, wherein configuring the first resonant structure to comprise the first portion having the inductive impedance and at least the second portion having the capacitive impedance comprises:

forming the first portion and the second portion of the first resonant structure as a parallel resonant circuit.

3. The method of claim 1, wherein configuring the first resonant structure to comprise the first portion having the inductive impedance and at least the second portion having the capacitive impedance comprises:

forming the first portion and the second portion of the first resonant structure as conductive traces on a printed circuit board.

4. The method of claim 1, further comprising:

configuring at least a second resonant structure to resonate at or near a second operating frequency of the antenna of the wireless communication device; and electromagnetically coupling the second resonant structure to the antenna to mitigate the near electric fields at the second operating frequency.

5. The method of claim 4, wherein configuring the second resonant structure to resonate at or near the second operating frequency of the antenna of the wireless communication device comprises:

configuring the second resonant structure to comprise at least a first portion having an inductive impedance and at least a second portion having a capacitive impedance.

6. A method of mitigating near electric fields generated by a wireless communication device, comprising:

configuring at least a first resonant structure to resonate at or near at least a first operating frequency of an antenna of the wireless communication device;

electromagnetically coupling the first resonant structure to the antenna to mitigate the near electric fields at the operating frequency, wherein electromagnetically coupling the first resonant structure to the antenna comprises positioning a guide medium comprising a conductor or a waveguide between the antenna and the first resonant structure, a first port of the guide medium being electromagnetically coupled to the antenna, and a second port of the guide medium being electromagnetically coupled to the first resonant structure; and coupling a transmitter to the antenna, the transmitter being configured to communicate electromagnetic signals to the antenna.

7. A method of mitigating near electric fields generated by a wireless communication device, comprising:

configuring a first resonant structure to resonate at or near at least a first operating frequency of an antenna of the wireless communication device;

electromagnetically coupling the first resonant structure to the antenna to mitigate the near electric fields at the operating frequency;

configuring at least a second resonant structure to resonate at or near a second operating frequency of the antenna of the wireless communication device, wherein configuring the second resonant structure to resonate at or near the second operating frequency of the antenna of the wireless communication device comprises positioning a guide medium comprising a conductor or a waveguide between the antenna and the second resonant structure, a first port of the guide medium being electromagnetically coupled to the antenna, and a second port of the guide medium being electromagnetically coupled to the second resonant structure;

electromagnetically coupling the second resonant structure to the antenna to mitigate the near electric fields at the second operating frequency; and coupling a transmitter to the antenna, the transmitter being configured to communicate electromagnetic signals to the antenna.

8. An RF circuit for a wireless communication device, comprising:

an antenna;

a transmitter that communicates electromagnetic signals to the antenna; and at least a first resonant structure configured to resonate at or near an operating frequency of the antenna;

wherein the first resonant structure is electromagnetically coupled to the antenna to mitigate the near electric fields at the operating frequency, and the first resonant structure does not include a feed port; and wherein the first resonant structure comprises:

at least a first portion having an inductive impedance; and at least a second portion having a capacitive impedance; and wherein the second portion of the first resonant structure is positioned proximate to a ground plane to establish the capacitive impedance between the second portion and the ground plane; and wherein a first port of the first portion of the first resonant structure is electrically coupled to the second portion of the first resonant structure; and a second port of the first portion of the first resonant structure is electrically coupled to a ground potential; and wherein the first portion and the second portion are coplanar.

9. The RF circuit of claim 8, wherein: the first portion and the second portion of the first resonant structure form a parallel resonant circuit.

10. The RF circuit of claim 8, wherein: the first portion and the second portion of the first resonant structure are configured as conductive traces on a primed circuit board.

11. The RF circuit of claim 8, further comprising:

at least a second resonant structure configured to resonate at or near a second operating frequency of the antenna of the wireless communication device;

wherein the second resonant structure is electromagnetically coupled to the antenna to mitigate the near electric fields at the second operating frequency.

12. The RF circuit of claim 11, wherein the second resonant structure comprises:

at least a first portion having an inductive impedance; and at least a second portion having a capacitive impedance.

13. An RF circuit for a wireless communication device, comprising:

an antenna;

a transmitter that communicates electromagnetic signals to the antenna; and at least a first resonant structure configured to resonate at or near an operating frequency of the antenna; and a guide medium comprising a conductor or a waveguide positioned between the antenna and the first resonant structure, a first port of the guide medium being electromagnetically coupled to the antenna, and a second port of the guide medium being electromagnetically coupled to the first resonant structure;

wherein the first resonant structure is electromagnetically coupled to the antenna via the guide medium to mitigate the near electric fields at the operating frequency.

14. An RF circuit for a wireless communication device, comprising:

an antenna;

a transmitter that communicates electromagnetic signals to the antenna;

a first resonant structure configured to resonate at or near an operating frequency of the antenna;

at least a second resonant structure configured to resonate at or near a second operating frequency of the antenna of the wireless communication device; and a guide medium comprising a conductor or a waveguide that is positioned between the antenna and the second resonant structure, the guide medium comprising a first port that is electromagnetically coupled to the antenna, and a second port that is electromagnetically coupled to the second resonant structure;

wherein the second resonant structure is electromagnetically coupled to the antenna via the guide medium to mitigate the near electric fields at the second operating frequency.

* * * * *